US005080408A

United States Patent [19]

McBay

[11] Patent Number: 5,080,408

[45] Date of Patent: Jan. 14, 1992

[54] PARTITION GATE LATCH

[76] Inventor: Charles G. McBay, 2018 Lankestar Way, Yukon, Okla. 73099

[21] Appl. No.: 707,757

[22] Filed: May 30, 1991

[51] Int. Cl.[5] ..... E05C 3/10

[52] U.S. Cl. ..... 292/254; 292/DIG. 29; 292/221

[58] Field of Search ..... 296/100; 292/254, DIG. 29, 292/DIG. 32, DIG. 43, 221

[56] References Cited

U.S. PATENT DOCUMENTS

| | | | |
|---|---|---|---|
| 103,143 | 5/1870 | Clymo | 292/254 |
| 914,798 | 3/1909 | Connor | 292/254 |
| 1,371,547 | 3/1921 | Burky | 292/254 |
| 3,508,777 | 4/1970 | McBurnie | 292/254 |
| 4,252,363 | 2/1981 | Rodrique | 292/254 X |

*Primary Examiner*—Richard E. Moore

*Attorney, Agent, or Firm*—Richard C. Litman

[57] ABSTRACT

A latching assembly for the partition gate of livestock trailers allows for the partition gate to be opened from inside the trailer as well as outside the trailer. The outside opening device includes a handle in communication with a latch plate pivotally mounted inside the trailer and which is constantly biased toward a normal lock position adapted to block or retain the swinging edge member of the gate when in a closed position. By pulling on the handle, the plate is displaced toward the trailer wall, against the action of the biasing device, and allows the gate to swing open. An internal handle is rotatably pivotable about its mount on the gate so that when pulled downwardly, causes the latch plate which to be outwardly displaced, out of the way of the gate to allow the gate to swing open.

7 Claims, 3 Drawing Sheets

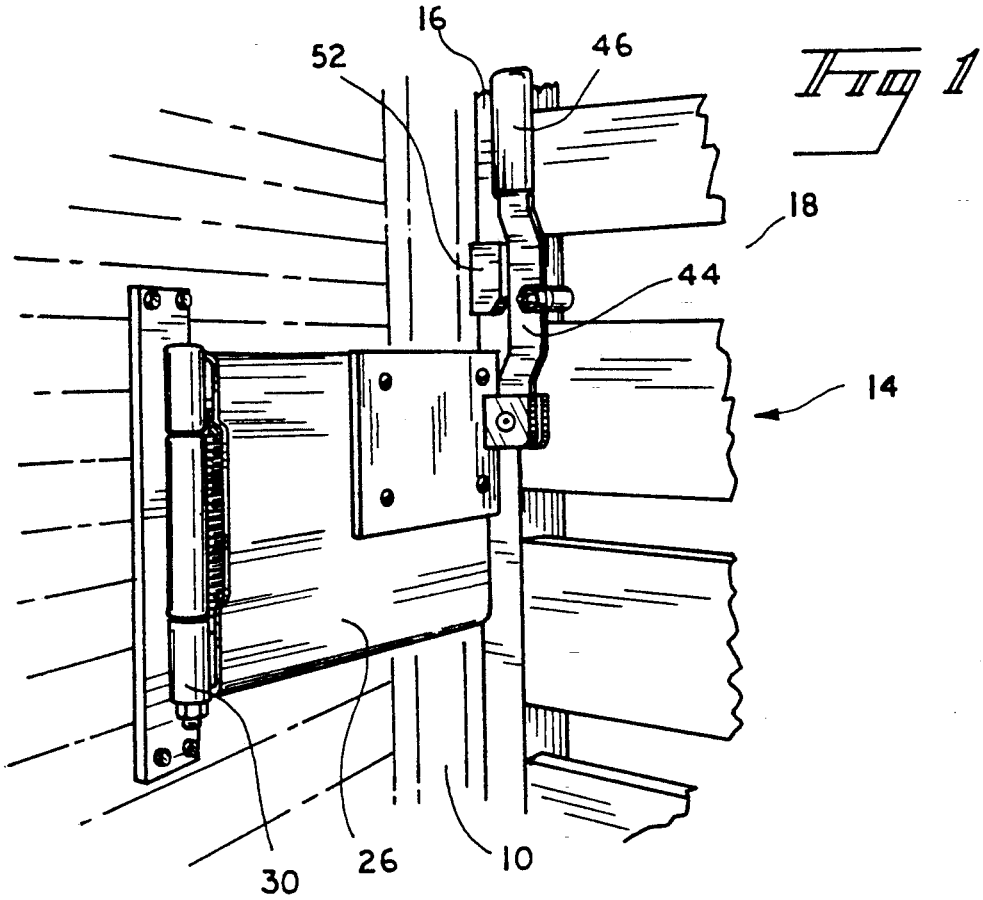
Fig 1
Fig 2
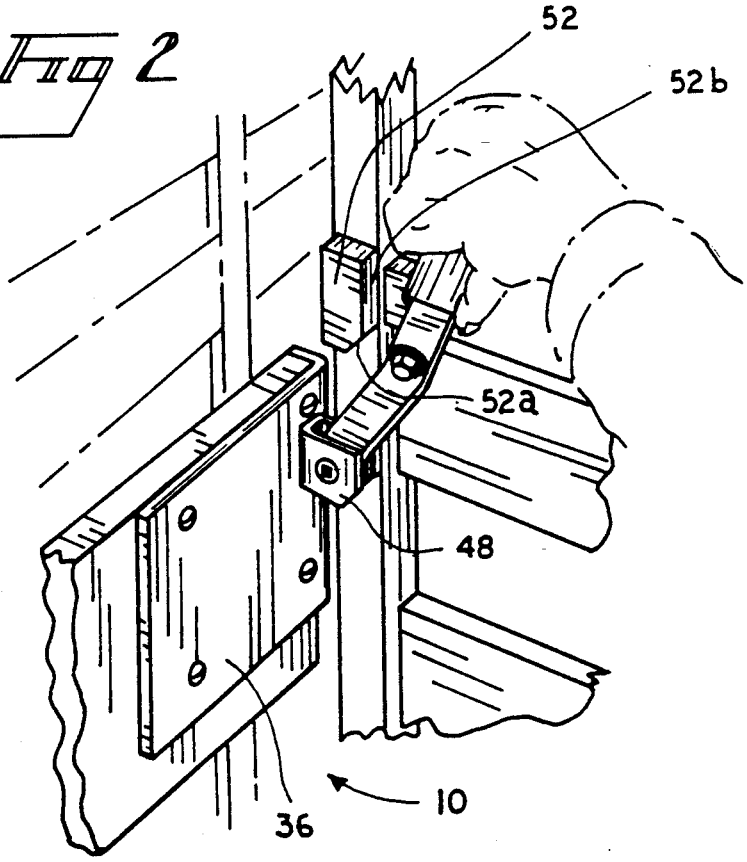

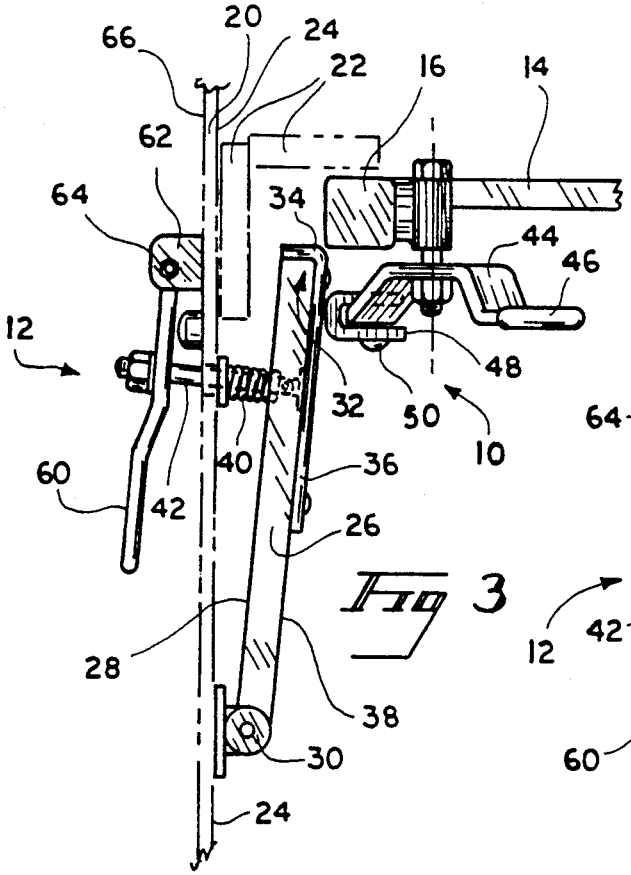
Fig 3
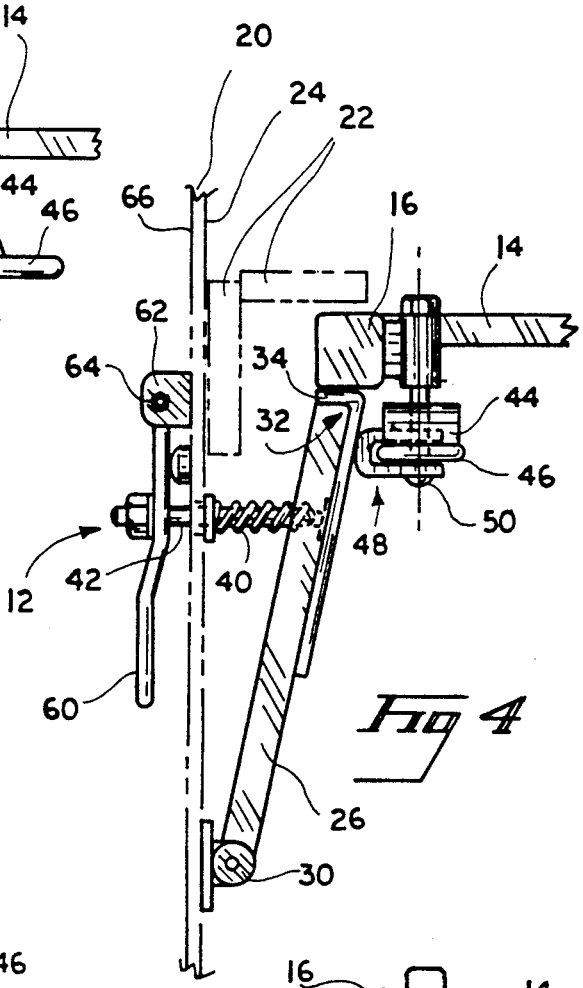
Fig 4
Fig 5
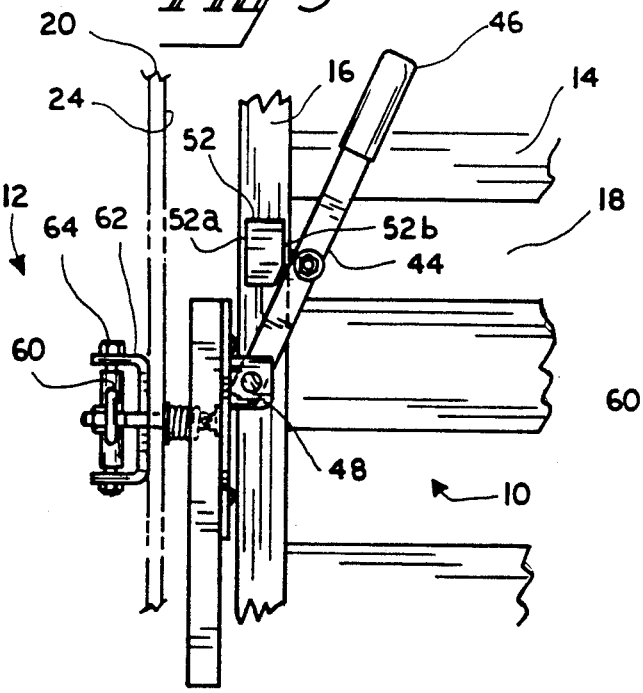
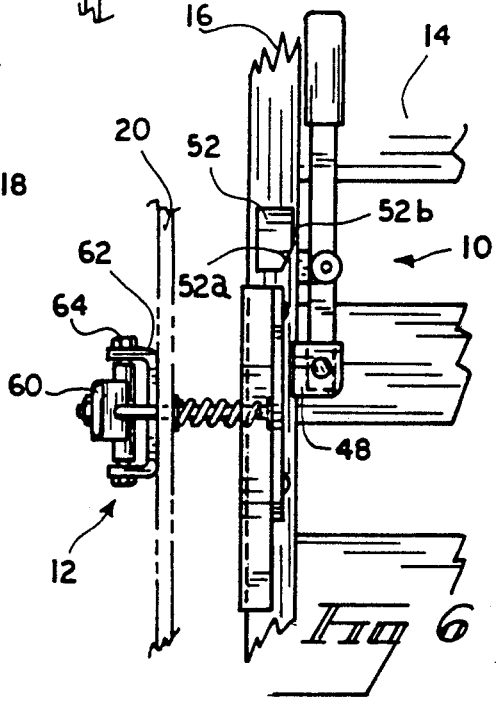
Fig 6

46
14
16
44
10
20
34
32
36
64
12
26
42
40
72
74
62
70
68
60
76

PARTITION GATE LATCH

FIELD OF THE INVENTION

The present invention relates to gate latches for livestock trailer partition gates designed to partition livestock trailers into discreet areas. More specifically this invention relates to latches which can be actuated from both the inside and the outside of a livestock trailer thus allowing a partition gate located about the midsection of the trailer to swing open.

DESCRIPTION OF THE PRIOR ART

Latches which can be actuated by more than one means are generally known in the art.

U.S. Pat. No. 1,927,720 issued to St. Clair discloses a gate attachment with a latch device allowing the latch to be actuated from either side of the gate. The latch is designed to be actuated by the motion of the material being transported within the storage area bounded by the gate.

U.S. Pat. No. 2,745,691 issued to Maloney discloses a handle and latch assembly that can be actuated from either side of a door by either a push or a pull.

None of the above inventions and patents, taken either singly or in combination, is seen to describe the instant invention as claimed.

SUMMARY OF THE INVENTION

This invention relates to a latching mechanism designed to secure a gate which serves as an inner partition inside a livestock trailer. This latching mechanism can be actuated from inside or outside the trailer. The inside mechanism consists of a handle assembly mounted on a movable gate which by its action pushes a gate latch plate out of blocking engagement of the gate itself. The latch plate is biased in a blocking position by a coil spring which is compressed when the mechanism is actuated. The gate latch plate is hinge mounted on the inside trailer wall. The outside mechanism includes an actuating handle mounted outside the trailer and in direct communication with the gate latch plate by a secured rod. When this handle is actuated the rod pulls the gate latch plate out of blocking position of the movable gate. This again compresses the coil spring which, when the handle is not actuated, biases the gate latch plate into blocking engagement of the movable partition gate. With this arrangement, a user may safely release a latched partition gate from exteriorly of a livestock trailer.

Accordingly, one object of the present invention is to provide a trailer partition gate with a latching mechanism which can be opened from both inside and outside the trailer.

Another object of the present invention is to provide a partition gate inside actuation means that is mounted on the partition gate itself.

Another object of the present invention is to provide a latch mechanism which is easy to use, install and maintain.

These and other objects of the present invention will become readily apparent upon further review of the following specification and drawings.

BRIEF DESCRIPTION OF THE DRAWINGS

FIG. 2 is a top plan view of the trailer partition gate latch in the gate unsecured position;

FIG. 3 is a top plan view of the partition gate latch in the gate unsecured position;

FIG. 4 is a top perspective view of the partition gate latch in the gate secured position;

FIG. 5 is an end elevation view of the partition gate latch in the gate unsecured position;

FIG. 6 is an end elevation view of the partition gate latch in the gate secured position; and FIG. 7 is a fragmentary perspective view from outside the trailer sidewall, with the partition gate latch in the secured position.

Similar reference characters denote corresponding features consistently throughout the attached drawings.

DETAILED DESCRIPTION OF THE PREFERRED EMBODIMENT

Figure 1:
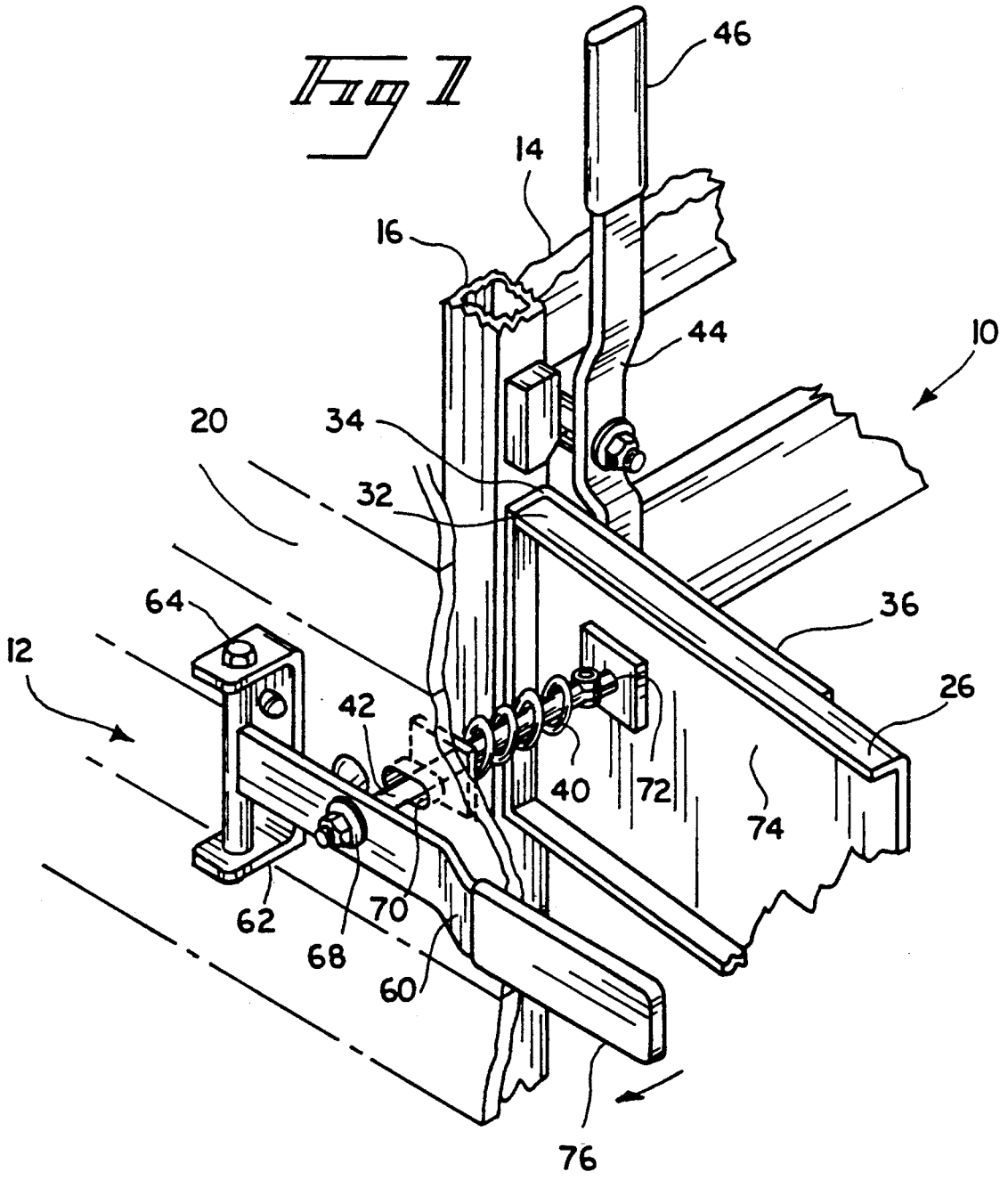
FIG. 1 is an inside view of the trailer partition gate latch in the gate secured position.

Referring now to the drawings, the dual latch mechanisms of the present invention are shown most clearly in FIGS. 3-7. The inside latch assembly is generally designated 10 while the outside latch assembly is designated 12. The two assemblies serve to provide alternate actuating means for unlatching the partition gate 14. This gate includes a free or swinging edge member 16 and is adapted for swinging displacement to expose or enclose, a gate opening 18 as exists between the two sidewalls of a livestock trailer. For purposes of clarity, but one trailer sidewall 20 is shown in the drawings, as the latching mechanisms are associated with only one such sidewall and any suitable type of pivot or hinge means may be utilized at the other edge of the gate 14.

To limit the closure of the gate 18, a gate stop 22 projects inwardly of the sidewall inside face 24 and the gate is normally retained in this closed position, by means of a latch plate 26. As shown most clearly in FIG. 4, the rear portion 28 of the latch plate 26 is pivotally attached to the sidewall inside face 24 by means of a hinge or pivot pin 30 while the opposite, forward portion 32 is adapted for horizontal displacement between the alternate unlocked and locked positions shown in FIGS. 3 and 4. The latch plate forward portion provides a lock nose 34 presenting an abutment for the gate edge member 16 and which retains the gate in the closed position, as in FIG. 4. Preferably, a wear plate 36 covers the forward edge of the latch plate as well as a substantial portion of its inner face 38.

The latch plate 26 is normally urged to the position of FIG. 4 by biasing means intermediate the plate and adjacent sidewall 20. Although any suitable spring means may be utilized to provide this biasing action, preferably a coiled spring 40 is used and in combination with an elongated displacement rod 42 forming a part of the outside latch assembly 12.

The inside latch assembly 10 is intended to be utilized primarily when closing the gate from within the trailer but also allows for an alternative manner of opening the gate when an operator determines it is safe to do so, such as when readying the trailer for loading of livestock. The inside latch assembly 10 includes a handle 44 having a handgrip 46 and bearing member 48 at opposite ends and wherein the handle is pivotally attached to the gate by means of an intermediate pivot fastener 50 mounted adjacent the gate edge member 16.

With the above construction in mind, the operation of the inside latch assembly may be described. When the gate is in the locked or closed position, the components will appear as in FIGS. 1,4,6 and 7 wherein the spring 40 maintains the lock nose 34 of the latch plate 26 in abutment with the gate edge member 16, thus retaining the gate in the closed position, sealing off the gate opening 18. When it is desired to open the gate from within the trailer, an operator merely grasps the handgrip 46 of the vertically disposed inner handle 44 and moves the handle in a clockwise direction, to the position as shown in FIGS. 2,3 and 5. During this displacement, the bearing element 48 on the lower end of the handle 44, has forced the latch plate and its lock nose 34 away from the gate edge member 16 and toward the sidewall 20, against the force of the spring means 40. While holding the handle in this displaced position, the operator is free to pull the handle 44 rearwardly to swing open the gate, since the lock nose 34 of the latch plate is being held out of the path of the gate. During this swinging movement of the gate, the handle bearing element 48 will be understood to slide across the surface of the wear plate 36 on the latch plate and when the gate edge member 16 is engaged by the angularly disposed latch plate, it will follow that upon release of the handle 44, the biasing force of the spring 40 will urge the latch plate away from the sidewall 20, with the resultant camming action between the latch plate and gate edge producing a boosting force assisting in the opening of the gate.

A limit block 52 is mounted on the gate to restrict the pivotal movement of the handle 44 after it has displaced the latch plate the necessary distance to permit clearance of the pivotal movement of the handle 44 after it has displaced the latch plate the necessary distance to permit clearance of the gate. The degree of necessary displacement is depicted in the view of FIG. 5. When the gate 18 is to be closed, merely swinging it toward a position normal to the sidewall 20 will result in the gate edge member 16 initially engaging the latch plate wear surface 36 and thence deflecting the latch plate against the force of the spring 40, until the edge member 16 passes the latch plate nose 34 at which point the spring 40 snaps the latch plate to the full locked position of FIGS. 1,4 and 6. During the above opening and closing of the gate 18, the limit block 52 on the gate will be understood to serve two functions. The angled or inclined surface 52*a* on this block provides an abutment for the handle 44 to limit the movement of the handle bearing element 48 toward the trailer sidewall 20. This precludes the bearing element 48 from being displaced to a point where it would strike the rear edge 28 of the latch plate 26 when the gate is being closed. On the other hand, the vertical surface 52*b* of the limit block provides an abutment to prevent the handle grip 46 from moving past top dead center at any time and thus insures that a user's knuckles will not engage the sidewall when grasping the handle.

When it is desired to manipulate the latch mechanism from exteriorly of the trailer sidewall 20, such as when livestock forward of the gate are to be off loaded, the outside latch assembly 12 is utilized. The same displacement of the latch plate 26 relative the gate edge member 16 occurs as above described but the mechanism for actuating this displacement forms a part of and is manipulated by the outer handle 60. This handle includes an anchored end 62 affixed to a vertical hinge or pivot pin 64 attached to the outside face 66 of the sidewall 20. The aforementioned displacement member 42 comprises an elongated element or rod having an outer end 68 secured to the medial portion of the handle 60 and projects inwardly of the trailer through an opening 70 in the sidewall 20 with its inner end 72 suitably attached to the outside face 74 of the latch plate 26, as shown most clearly in FIG. 7. With the captive spring 40 encircling the rod 42 and its opposite ends constantly applying a biasing force between the sidewall and latch plate, it will be understood that displacement of the latch plate 26 from its closed position of FIG. 4 to the opened position of FIG. 3 is readily accomplished merely by grasping the outer handle handgrip 76 and pulling outwardly thereupon. When this occurs, the movement of livestock behind the gate 18 causes the gate to swing open. As an alternative, spring means (not shown) may be included in the hinge connection of the pivot end of the gate to urge it into an opened position when the latch plate lock nose 34 is displaced clear of the gate edge member 16.

With the foregoing description in mind it will be appreciated that an improved latching mechanism for the partition gate of a livestock trailer is provided and wherein the unlatching of the gate may be readily accomplished either by means of a unique inside or outside latch assembly.

It is to be understood that the present invention is not limited to the sole embodiment described above, but encompasses any and all variations falling within the scope of the appended claims.

I claim:

1. In a latch assembly for a partition gate within a trailer having opposed sidewalls, the improvement comprising;

one said sidewall having inside and outside faces, a latch plate disposed adjacent said inside face and having a lock nose, said gate swingable to substantially span a gate opening between said sidewalls and having a switching edge member juxtaposed said one said sidewall inside face when said gate is swung to a closed position blocking said gate opening, means pivotally mounting said latch plate relative said sidewall inside face to permit displacement of said lock nose toward and away from said sidewall inside face, biasing means normally urging said latch plate away from said sidewall inside face and into a locked position with said lock nose in blocking engagement with said gate swinging edge member, inside and outside actuating means operable respectively from inside and outside said trailer to displace said latch plate lock nose toward said sidewall inside face against the force of said biasing means to permit swinging of said gate and exposure of said gate opening, said inside actuating means including an inner handle pivotally attached to said gate adjacent said gate swinging edge and movable in a substantially vertical plane, said inner handle having a free end movable to engage and displace said latch plate, said outside actuating means including an outer handle pivotally attached to said sidewall outside face and movable in a substantially horizontal plane, and a displacement member carried by said outer handle, passing through said one said sidewall and connected to said latch plate, whereby said latch plate is pivotally displaceable against the force of said biasing means by optional means comprising said inner handle from within said trailer and said outer handle from outside said trailer.

2. The latch assembly as claimed in claim 1 wherein the biasing means comprises a coil spring.

3. The latch assembly as claimed in claim 1 including, a stop block affixed to said gate adjacent said edge member to limit the displacement of said inner handle.

4. The latch assembly as claimed in claim 1 wherein, said pivotally mounting means includes a vertically disposed hinge pin.

5. The latch assembly as claimed in claim 1 including, a bearing member pivotally attached to said inner handle free end.

6. The latch assembly as claimed in claim 1 wherein, said latch plate includes an inner face, and a wear plate on said inner face engageable by said inner handle free end.

7. The latch assembly as claimed in claim 2 wherein, said displacement member includes an elongated element, and said coil spring is disposed about said elongated element.

* * * * *